US005574957A

United States Patent [19]

Barnard et al.

[11] Patent Number: 5,574,957

[45] Date of Patent: Nov. 12, 1996

[54] METHOD OF ENCASING A STRUCTURE IN METAL

[75] Inventors: John M. Barnard, Wilmington, N.C.; Ronald E. Johnson, Tioga, Pa.; Kathleen A. Wexell, Corning, N.Y.

[73] Assignee: Corning Incorporated, Corning, N.Y.

[21] Appl. No.: 190,528

[22] Filed: Feb. 2, 1994

[51] Int. Cl.[6] ..... B22F 7/02

[52] U.S. Cl. ..... 419/67; 419/5; 419/6; 419/10; 419/19; 419/20; 419/36; 419/41

[58] Field of Search ..... 419/5, 6, 10, 19, 419/20, 36, 41, 67

[56] References Cited

U.S. PATENT DOCUMENTS

| | | | |
|---|---|---|---|
| 2,966,719 | 1/1961 | Park, Jr. | 264/66 |
| 3,007,222 | 11/1961 | Ragan | 25/156 |
| 3,112,184 | 11/1963 | Hollenbach | 264/59 |
| 3,444,925 | 5/1969 | Johnson | 165/166 |
| 3,790,654 | 2/1974 | Bagley | 264/177.4 |
| 3,794,707 | 2/1974 | O'Neill et al. | 264/56 |
| 3,824,196 | 7/1974 | Benbow et al. | 502/80 |
| 3,885,977 | 5/1975 | Lachman et al. | 106/62 |
| 3,919,384 | 11/1975 | Cantaloupe et al. | 264/177 R |
| 3,963,504 | 6/1976 | Lundsager | 106/41 |
| 4,017,347 | 4/1977 | Cleveland | 156/89 |
| 4,349,329 | 9/1982 | Naito et al. | 425/461 |
| 4,381,912 | 5/1983 | Yamamoto et al. | 425/461 |
| 4,384,841 | 5/1983 | Yamamoto et al. | 475/461 |
| 4,582,677 | 4/1986 | Sugino et al. | 419/2 |
| 4,649,003 | 3/1987 | Hasimoto et al. | 264/63 |
| 4,668,176 | 5/1987 | Zeibig et al. | 425/464 |
| 4,673,658 | 6/1987 | Gadkaree et al. | 501/89 |
| 4,871,621 | 10/1989 | Bagley et al. | 428/949 |
| 5,089,455 | 2/1992 | Ketcham et al. | 501/104 |

FOREIGN PATENT DOCUMENTS

| | | |
|---|---|---|
| 0 244 714 | 11/1987 | European Pat. Off. . |
| 53-26857 | 3/1978 | Japan . |
| 61-5915 | 1/1986 | Japan . |

*Primary Examiner*—Donald P. Walsh
*Assistant Examiner*—John N. Greaves
*Attorney, Agent, or Firm*—Timothy M. Schaeberle

[57] ABSTRACT

An improved method is disclosed for encasing an object in a shell or layer of outer material. The encased object and the outer material are formed from sinterable metal or ceramic particulate material. Both the object to be encased and the shell or encasement are formed by extrusion. Novel methods are disclosed by which the object and the outer material can be simultaneously formed by co-extruding the sinterable particulate materials, or by extruding the outer layer onto a formed object using the die assembly of the invention.

35 Claims, 6 Drawing Sheets

Fig. 1
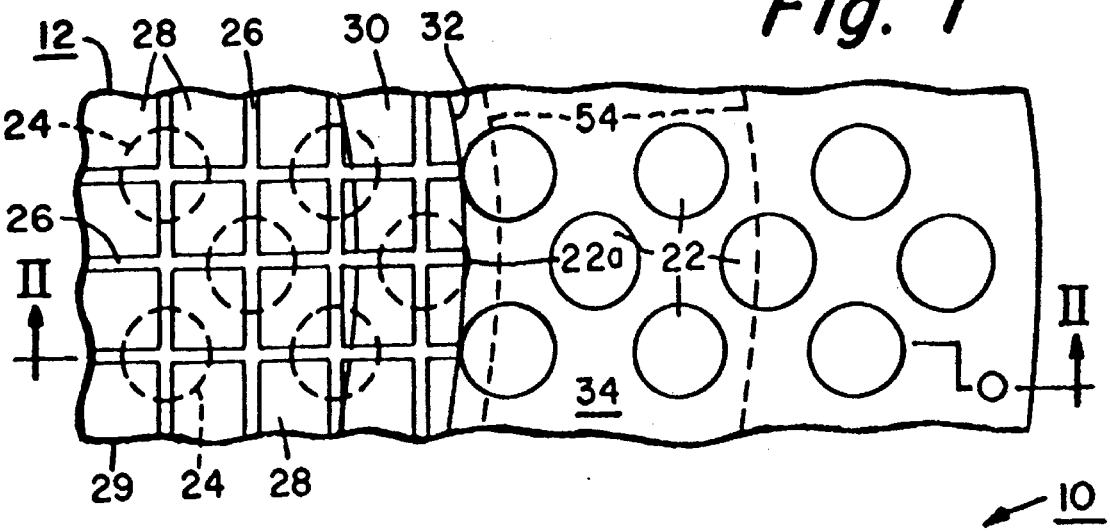
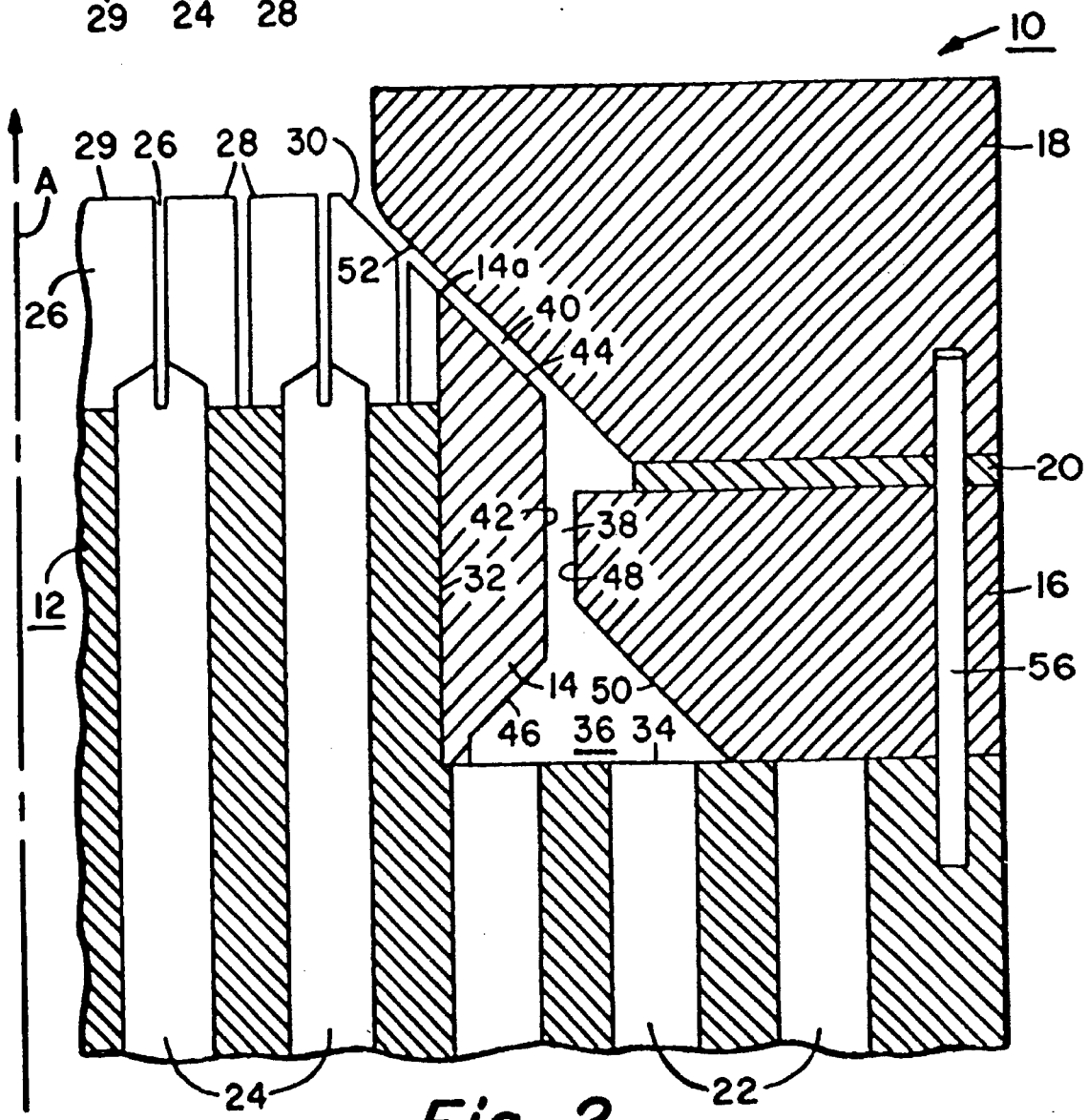
Fig. 2

METHOD OF ENCASING A STRUCTURE IN METAL

BACKGROUND OF THE INVENTION

This invention relates to a method of encasing objects, especially ceramic and metal objects.

Because of their high resistance to heat and oxidation, ceramic materials are used to manufacture a wide variety of industrial parts. Often, it is necessary or desirable to encase the ceramic part in metal so that it may be welded to other metal parts. For example, many catalytic converters used in automobiles include a metal or ceramic honeycomb structure, coated with catalyst, which structure is then encased in a metal can so that it may be welded to the automobile chassis. The process commonly used for encasing such catalytic converters in metal is costly and labor intensive. Typically, a piece of metal cut in a clam-shell shape is bent around the previously coated and fired substrate, held in that position and welded closed. Even if the metal casing is tightly fit around the converter at room temperature, the metal will expand differentially from the ceramic at higher temperatures, causing the ceramic to metal fit to loosen, allowing the converter to move within the casing during use and become damaged.

Recently, an improved method has been disclosed for encasing catalytic converters to reduce the effects of differential expansion on the encased object and the metal casing. In particular, it has been suggested to form the metal casing by wrapping a sheet of sinterable particulate metal around a green sinterable object, and firing the wrapped object to form a unitary structure.

There continues to be a need for metal encased articles which can be prepared by less costly and labor intensive methods and which will reduce the effects of differential expansion.

SUMMARY OF THE INVENTION

Briefly, the invention relates to an apparatus and method of forming an encased cellular structure by co-extruding a shell or encasement around the cellular structure.

In one aspect, the invention relates to an apparatus or die assembly comprised of a core or central portion having a cellular die body, and a cylindrical outer or peripheral portion having a variable width slot which is concentric to the core or central cellular die body. In particular, the die assembly is made up of (1) a die body having an inlet face and an outlet face and a matrix of interconnected pins, (2) a peripheral cylindrical surface concentric with the longitudinal axis of the die body, and an annular planar surface communicating with the cylindrical surface and extending transversely of the longitudinal axis, (3) an inner peripheral surface concentric with the peripheral cylindrical surface of the die body and spaced a given distance therefrom for forming a shell or encasement forming slot or gap therebetween and, (4) mechanism for adjusting the thickness of the shell or encasement.

In another aspect, the invention relates to a method of forming an encased cellular structure using the above die assembly by passing a first batch material longitudinally through the die body to form a cellular structure, and passing a second batch material longitudinally through the shell forming means to form a shell or encasement of the second batch material around the cellular structure. The resulting structure may then be dried and subsequently fired to form a sintered unitary structure having a central cellular portion, circumferentially encased in and surrounded by an outer material.

As used herein, the term "green" is used as that term is known in the art to refer to the state of a formed body or piece made of sinterable powder or particulate material which has not yet been fired to the sintered state.

BRIEF DESCRIPTION OF THE DRAWINGS

FIG. 1 is a fragmental plan view of a modified die which can be used to form the encased cellular structure of the present invention;

FIG. 2 is a fragmental sectional view in elevation taken along line II—II of FIG. 1;

DETAILED DESCRIPTION OF THE INVENTION

Figure 3B:
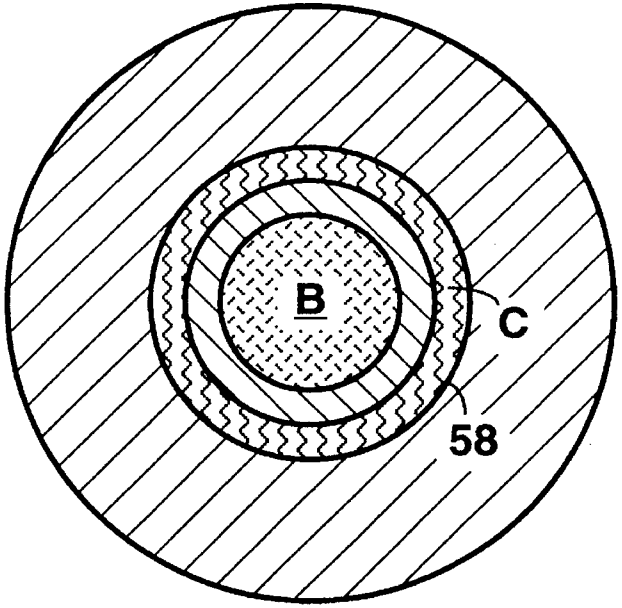
FIG. 3*b* is a cross-sectional view of the die assembly of FIG. 3*a* taken along line 3B—3B.

The method of the invention, that is, the co-extrusion of an outer shell and a core object, can be used to form a casing or shell around any extrudable object. The present invention is particularly suited for forming a metal casing around a central or core cellular structure such as a honeycomb structure of the kind commonly used in automotive emissions control applications. The structure to be encased is co-extruded with the encasement or shell material and the resulting unitary structure can be subsequently sintered to form a sintered object.

The core material (i.e., the cellular structure) which is preferably a cellular structure such as a honeycomb monolith is formed by passing extrudable batch material through a standard die. In one embodiment, a shell or encasement is formed around the cellular structure by co-extruding a second batch material around the cellular structure using a modified standard extrusion die.

In one particularly useful embodiment (FIGS. 1–4*b*), the encased structure of the invention is formed by simultaneously co-extruding a central, preferably cellular structure, and an outer shell, using a modified standard extrusion die such as disclosed in U.S. Pat. No. 5,089,203, herein incorporated by reference. The apparatus is a die assembly formed by modifying the outer peripheral face of a standard extrusion die such as disclosed in U.S. Pat. No. 3,790,654, to provide flow control means, and means for controlling the thickness of the outer casing as shown in FIGS. 1 and 2. Alternatively, the encased structure of this embodiment can be formed using a die assembly which includes a die body having an inlet face and an outlet face, a peripheral cylindrical surface concentric with the longitudinal axis of the die body, and an annular planar surface in communication with the cylindrical surface and extending transversely of the longitudinal axis. A shell or encasement forming means having an inner peripheral surface concentric with the peripheral cylindrical surface of the die body is spaced a given distance from the cylindrical surface to provide a gap between the inner peripheral surface and the cylindrical surface. The die assembly includes means for adjustably positioning the encasement forming means from the peripheral cylindrical surface of the die body to provide a desired shell or encasement thickness as illustrated in FIGS. 3*a*–4*b*.

In another embodiment (FIGS. 5*a*–7), the encased structure of the invention is formed by forming a central or core structure using a die body, and subsequently forming a shell around the central structure. In this embodiment, the shell may be formed immediately after the central structure is formed, or alternatively, the shell may be formed a substantial distance and/or time after the central structure is formed.

Referring now to FIGS. 1 and 2, a preferred embodiment of the extrusion die assembly of the present invention is shown at 10 comprising a relieved die body 12, a trim ring 14, a flow control plate 16, a mask 18, and a shim 20. The die body 12 may be a typical automotive catalytic converter type extrusion die having peripheral feed holes 22, central feed holes 24 communicating at one end with an inlet face and at the other with a plurality of interconnected discharge slots 26 forming pins 28 therebetween in an outlet face 29, which die has been modified in its peripheral area by the removal of the peripheral pins and a portion of the peripheral feed holes 22. The machining operations producing the relieved die result in the formation of a tapered or frusto-conical surface 30, a peripheral cylindrical surface 32 which lies substantially concentric with the longitudinal axis A of the die body, and an annular planar surface 34 extending transversely of axis A and intersecting the peripheral feed holes 22.

As shown in FIG. 2, a batch reservoir 36 is formed between relieved portions of the trim ring 14 and the flow control plate 16 adjacent planar surface 34, an adjustable flow control gap 38 is provided between complementary surfaces of the trim ring 14 and flow control plate 16, and a shell forming gap or variable width slot 40, determining the thickness of the casing or shell 60, is formed between complementary surfaces of the die 12 and trim ring 14 with the mask 18. However, as noted in FIG. 1, the machining operation modifying the peripheral area of the die body 12, exposes partial holes 22*a* around the die communicating with the cylindrical vertical surface 32. In view of the fact that such partial holes 22*a* could provide unwanted flow passages which would circumvent the desired flow control gap 38, the trim ring 14 is installed about the peripheral cylindrical surface 32 of die body 12 to seal off such partial holes.

The trim ring 14 is a cylindrical member, preferably of a hardenable material, shrunk fit or otherwise held in place as by welding or soldering onto the die 12 about the peripheral cylindrical surface 32. The point 14*a* of the trim ring 14 must be outwardly of the outer extent of the feed holes 24 to provide a complete separation between the feed holes 24 adjacent cylindrical surface 32, and insure a complete blocking off of any possible batch flow from the partial feed holes 22*a* into the variable width slot or gap 40.

The trim ring 14 is machined to its final dimensions after the ring is installed in place on the die 12 to insure proper concentricity of the fixed peripheral face 42, forming one side of the flow control gap 38, with the center line or longitudinal axis A of the die body 12. Such post-installation machining also guarantees a uniform smoothness and contiguous extension of the tapered or frusto-conical surface 30 of the die 12 and the tapered, frusto-conical surface 44 of the ring, which together comprise a contiguous shell forming surface on one side of the shell forming gap 40. Further, an inner portion 46 of the trim ring is configured to form one side of the reservoir 36.

The key role of the flow control plate 16 is to form the opposite face 48 of the flow control gap 38, which meters the flow of batch material into the outer variable width slot or gap 40. The dimension of the inner peripheral face 48 of the flow control plate 16 can be varied in a succession of flow control plates 16 to provide a range of adjustment possibilities for the. adjustable flow control gap 38, by merely substituting one removable flow control plate 16 for another of a different inner peripheral diameter. An upstream or inner surface 50 of the flow control plate 16 forms an opposite side from surface 46 of the batch reservoir 36. Although not a preferred embodiment due to residual memory in the batch, if desired, the flow control gap 38 could be in the form of a circular ring of closely spaced metering holes formed through plate 16.

The shell former or mask 18 is analogous to a traditional mask, and has a tapered or frusto-conical surface 52 which forms the outer confining surface of the shell forming gap 40, while the contiguous tapered or frusto-conical surface portions 30 of the die and 44 of the trim ring form the inner confining surface of the shell forming gap 40.

Upon extrusion of a honeycomb structure through the central or core die 12, the internal webs formed by the interconnected discharge slots 26 begin to knit with the shell formed in the shell forming gap 40 at the outer most point 14*a* of the ring 14, and the internal webs continue to knit with the shell between point 14*a* and the exit from the die.

The thickness of the shim 20 determines the width of the shell forming gap 40. In other words, a variety of shims, of variable thickness, may be provided as desired, to adjust the thickness of the shell forming gap 40. In essence, the volume of flow is controlled by the adjustable flow control gap 38 upstream of the shell forming gap 40, whereas the actual shell thickness is determined by the thickness of the shim 20 utilized in the die assembly. Both elements of flow control and shell thickness must work cooperatively to achieve the delicate balance between proper volumetric metering of batch, and shell thickness and velocity. The shell forming batch, enters the die through peripheral feed holes 22 and is collected in the reservoir 36, and is first subjected to shaping influences and pressures in the flow control zone 38 between the trim ring 14 and the flow control plate 16. This pressure is sustained as the now roughly configured sheet of shell enters the gap 40 between the mask 18 and die 12, and traverses the increasingly smaller annular space within such gap. The reservoir 36 is designed to furnish a reservoir into which batch may flow in great abundance. Because the feed holes 22 below the reservoir 36 are much shorter than the central feed holes 24, the impedance in the peripheral feed holes 22 is appreciably less, and thus an abundant delivery of shell forming batch material is assured to the reservoir. The width of the reservoir intersecting planar surface 34 of die 12 should span at least 2 ½ to 3 feed hole centers, as shown by the phantom lines 54 in FIG. 1, in order to dampen out the discrete flow effects from single feed holes.

A plurality of slip-fit dowels 56 may be utilized to align the mask, the adjustable thickness shim and the removable gap flow control plate with the die body 12, to form the extrusion die assembly of the present invention. Further, although it is preferred that the confining walls 52 and 30,44 of the variable width slot 40 be parallel, if desired such surfaces may be slightly tapered toward one another as they extend outwardly of the die so as to produce increased shearing effects.

According to the method of the invention, a cellular structure such as a honeycomb is formed by extruding a first batch material longitudinally through a central portion of a die body for forming a honeycomb structure having web portions, flowing a second batch material longitudinally through peripheral portions of the die body, and collecting such peripherally flowing second batch material within a reservoir. The volume of flow of batch material from the reservoir is controlled through an adjustable flow control gap which can be adjusted to a desired shell thickness using a variable width slot. A second batch material is then flowed from the adjustable flow control gap through the variable width slot to form the shell. While flowing such second batch material within the variable width slot, web or cell portions of the honeycomb are initially engaged and the second batch material is knitted with the web portions while still within the slot to provide a honeycomb structure with an integral outer encasement thereon.

Figure 3A:
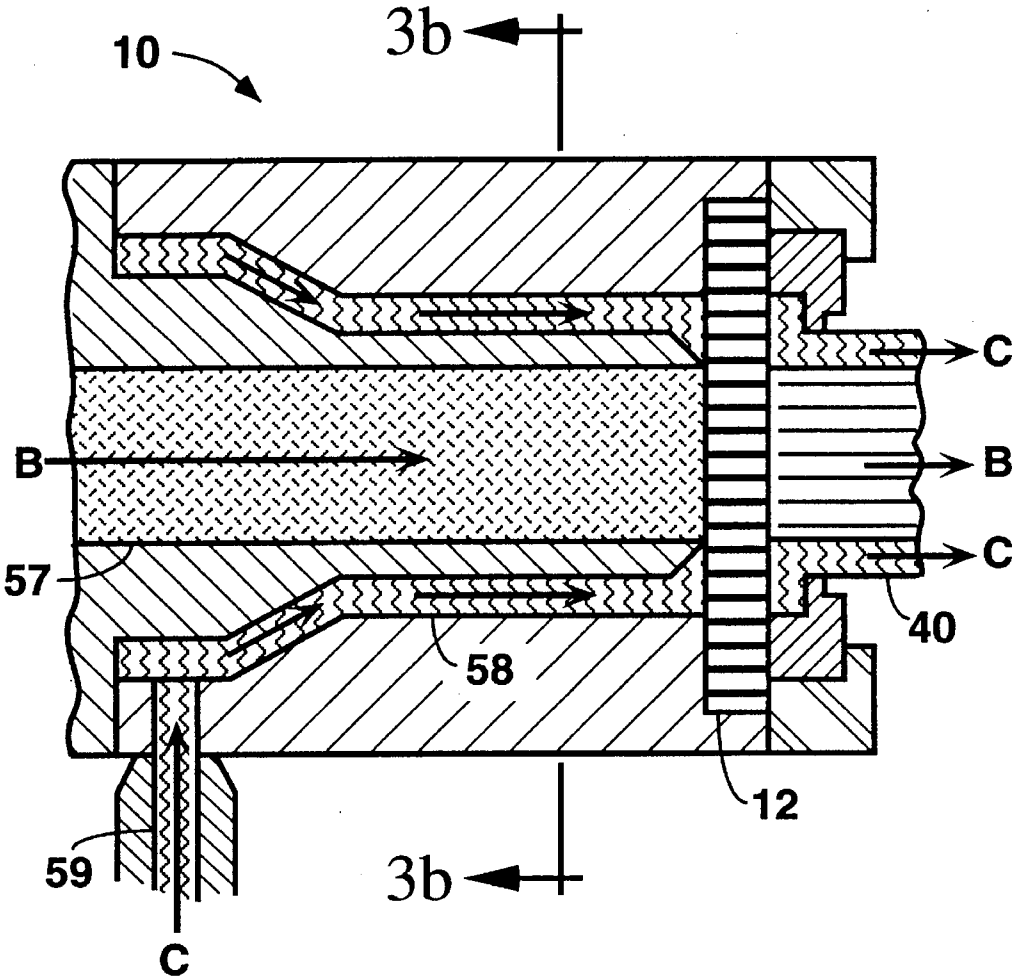
FIG. 3*a* is a schematic diagram of an extrusion die assembly of the invention in which the two materials to be co-extruded are separated by a pipe which terminates just at the upstream side of the cellular extrusion die.
Figure 4B:
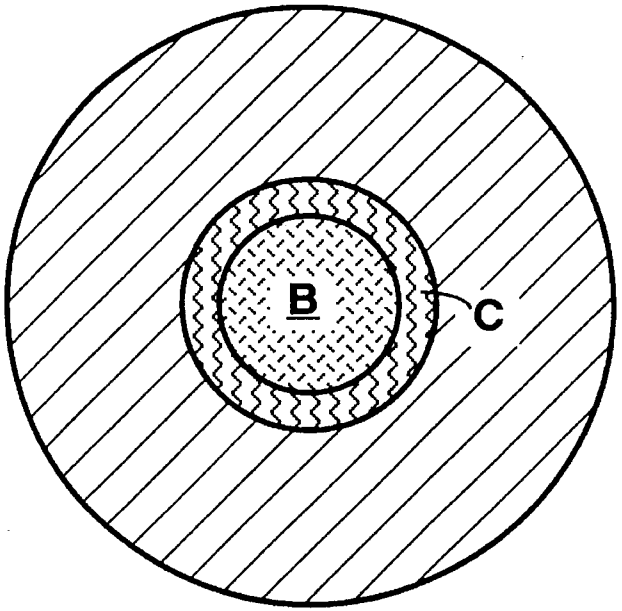
FIG. 4*b* is a cross-sectional view of the die assembly of FIG. 4*a* taken along line 4B—4B.
Figure 4A:
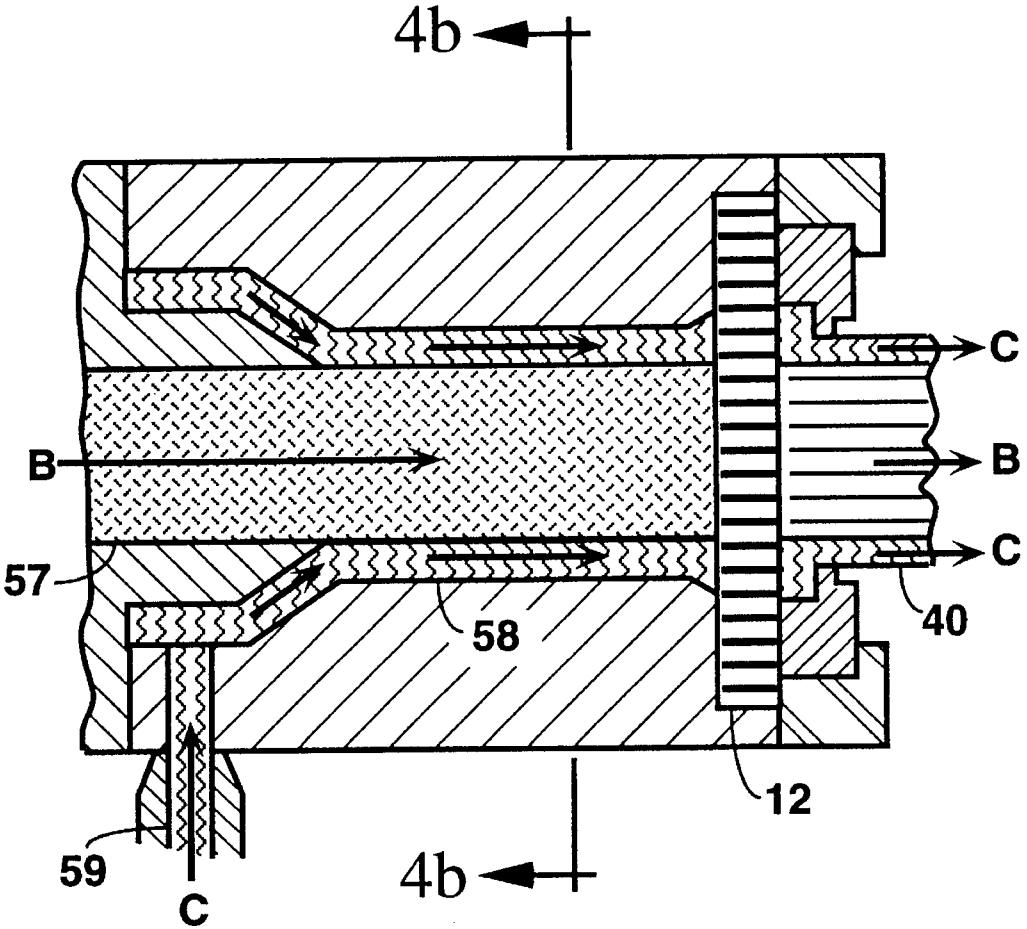
FIG. 4*a* is a schematic diagram of an extrusion assembly similar to FIG. 3, but in which the pipe terminates further upstream from the cellular extrusion die.

Referring now to FIGS. 3*a* to 4*b*, to form the encased cellular object of the invention, means are provided to (1) supply to the central or core die 12, a first batch material B for forming a cellular structure, and (2) supply to the shell forming or variable width slot 40, a second batch material C for forming the shell. In one embodiment (FIGS. 3*a* to 4*b*), upstream from the core die 12, the first batch material B is extruded through a cellular extruder 57, while the second batch material C is extruded through shell extruder 59. Optionally, the two batches may be separated from each other by a hollow pipe 58 which terminates at the upstream face of the core die 12, as shown in FIG. 3*a*. The pipe 58 is concentric to the first batch material B as shown in FIG. 3*b*. Alternatively, the two batch materials approach the core die 12 in contact with each other as shown in FIGS. 4*a* and 4*b*.

Figure 5B:
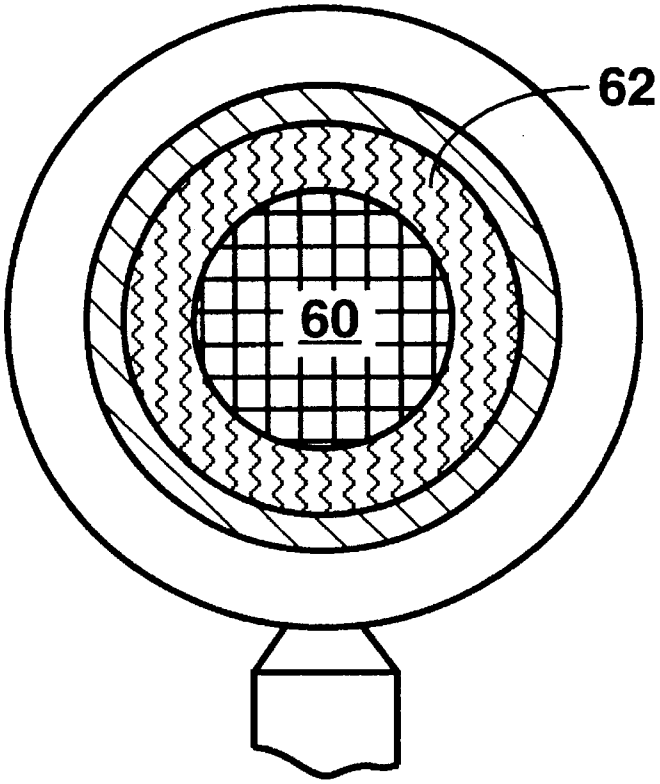
FIG. 5*b* is a cross-sectional view of the die assembly of FIG. 5*a* taken along line 5B—5B.
Figure 5A:
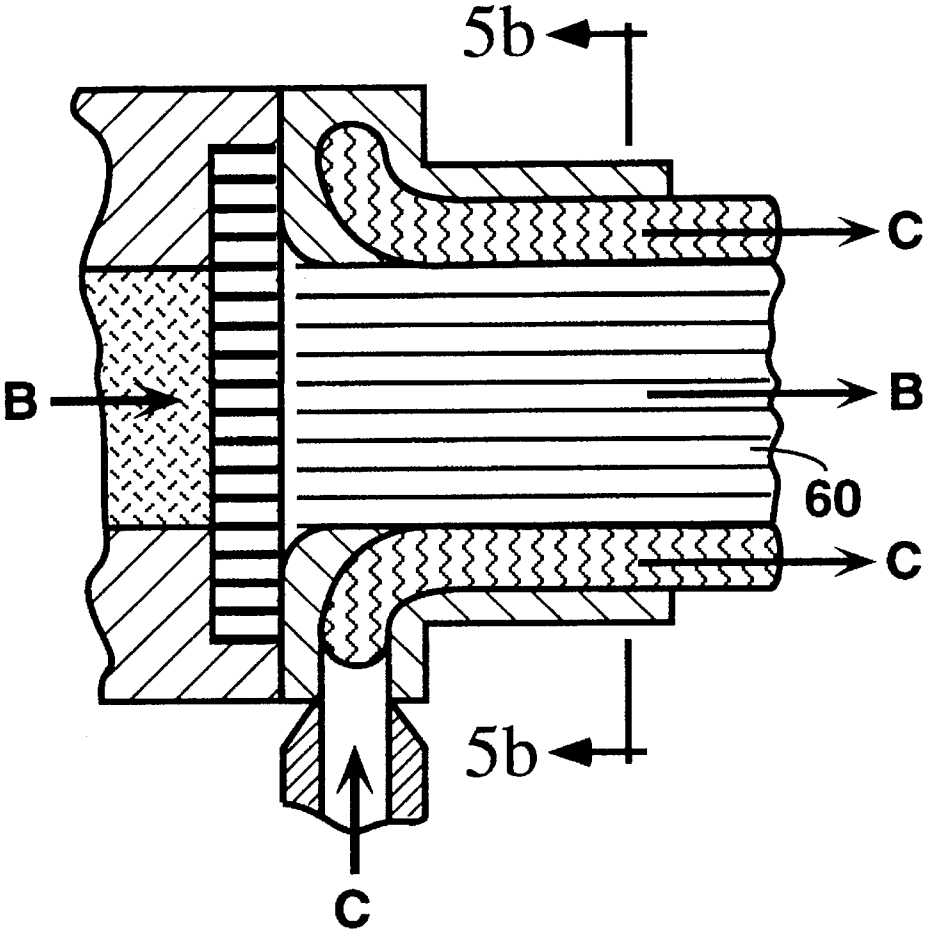
FIG. 5*a* is a schematic diagram of a die assembly of another embodiment of the invention in which the outer or encasing material is co-extruded around the periphery of the extruded cellular monolith, just on the downstream face of the cellular die.
Figure 6B:
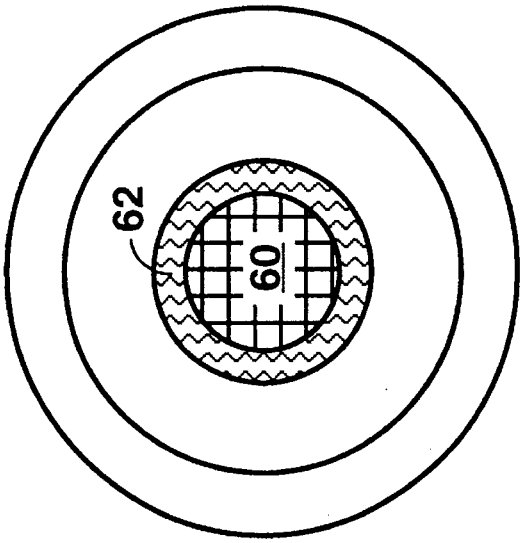
FIG. 6*b* is a cross-sectional view of the die assembly of FIG. 6*a* taken along line 6B—6B.
Figure 6A:
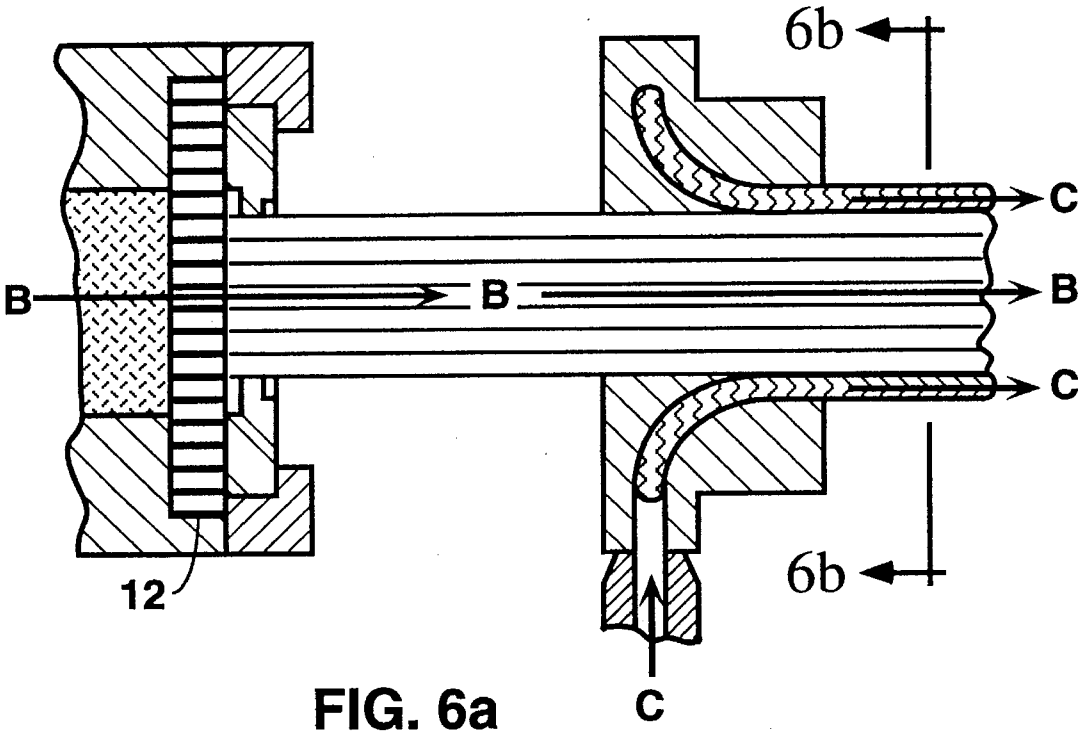
FIG. 6*a* is a schematic diagram of a die assembly similar to FIG. 5, but in which the outer or encasing material is co-extruded around the periphery of the extruded cellular monolith, but in which the encasing material is co-extruded further downstream from the cellular die.

In another embodiment, the cellular structure 60 is extruded using a standard extrusion die as shown in FIGS. 5*a* to 6*b*. Unlike the prior embodiments (FIGS. 1–4*b*), in which the two batches are co-extruded simultaneously, in this embodiment (FIGS. 5*a* to 6*b*), the second batch material C forming the shell 62 is extruded after the core cellular structure 60 has been extruded. The time lapse between formation of the cellular structure 60 and the shell 62 can vary from almost an instant as illustrated in FIG. 5*a*, to some time afterwards as illustrated in FIG. 6*a*. Similarly, the spatial separation between the two extruders can vary from substantial contact (FIG. 5*a*), to any desirable distance (FIG. 6*a*). The actual time lapse and spatial separation will depend on the particular system. However, we have found that the embodiments of FIGS. 3*a* through 5*a*, are particularly suited to systems in which the two batch materials are the same or substantially similar, both in rheology and in thermal properties. The embodiment of FIG. 6*a* can be used for any system regardless of the similarity in rheology between the different batch materials. Thus, the more similar the batch rheology, the easier it is to simultaneously co-extrude the cellular structure and the surrounding shell.

The object or structure to be encased may be any object capable of withstanding high firing temperatures such as metal, glass, glass-ceramic, ceramic, cermet metal, or a composite of any such material such as a matrix containing fibers and/or whiskers of the same or different material. Generally, such structures are formed from sinterable particles or powders which may optionally be intermixed with fibers and/or whiskers to form a reinforced composite. The cellular structure may be a "green, " sinterable metal or ceramic object which can be sintered simultaneously (i.e., co-fired) with a sinterable outer material. As contemplated by the invention, the encased object may be a dried preform, or a pre-fired (sintered) structure, provided such structure is capable of withstanding the sintering temperature of the outer layer. In addition, the cellular structure and the concentric outer shell may be formed of the same or similar material, provided the thermal expansion properties, and the sintering temperatures of the two materials are substantially similar. Preferably, the object to be encased is an extruded ceramic or metal honeycomb body, and the encasing material is metal. By honeycomb we mean a multichannel monolithic structure having a matrix of thin walls which form substantially parallel cells or passages extending between open end faces of the structure. The cells of the honeycomb can have any cross-sectional shape such as for example, circular, or polygonal. The size and dimensions of the structures are only limited by the desired application. Thus, the diameter, length, number of cells, or cell wall thickness can be any value depending on the limitations of the particular application.

The batch materials are formed from a slurry or batch of sinterable particles or powder (preferably metal), a binder, a suitable volatile component such as water, organic solvent or wax, and optionally, dispersants, wetting agents and plasticizers. Satisfactory extrusion binders generally are of two distinct types. The first type is based on water soluble binders, generally cellulosic ethers, particularly thermally gellable cellulosic ethers such as methyl cellulose. The second type of satisfactory extrusion binders are those based on thermoplastic polymers dissolved in a wax-based medium. These thermoplastic polymers are processed with heated extruders such as those used to extrude filled thermoplastic polymers. The wax-based binders can be formulated using well known techniques which permit flow for melt extrusion, but which provide shape retention during binder removal. Although two-phase wax binders, wax blends of progressively increasing melt points and other techniques for wax-based ceramic binders could be employed for this invention, we have found to be particularly useful, thermoplastic organic binder compositions exhibiting, and imparting to the batch the characteristic of reversible gelling behavior as more fully described below.

The volatile batch component may be a wax or a plasticizer which is only volatile at drying or dewaxing temperatures. Low melting point, volatile waxes can be generally characterized as fatty alcohol, fatty acid, fatty glycol, and fatty glyceride waxes, i.e., waxes comprising these compounds or other ester derivatives thereof, which are crystalline solids at room temperature and have melting points not exceeding about 80° C. Low molecular weight paraffinic waxes may also be used, although they exhibit somewhat lower volatility than the non-paraffinic waxes mentioned.

The preferred waxes, which principally comprise wax molecules of 14–20 carbon atoms and most preferably consist of 14–18 carbon fatty alcohol waxes, exhibit relatively rapid volatilization at temperatures above about 140° C. at standard pressure and even more rapid volatilization under vacuum.

The essential components of the preferred thermoplastic organic binder composition includes a low-melting wax component, serving as a solvent or matrix phase in the binder, and an organic polymer serving as a gel-forming species in the binder. These components are chemically and physically compatible, forming a homogeneous wax/polymer melt wherein the polymer is dissolved or dispersed in the molten wax. However, upon cooling from the melt, reversible gel linkages are formed between the polymer in the liquid wax such that the binder exhibits the behavior of a cross-linked gel. Examples of useful low-melting waxes include both octa- and hexa-decanol.

The high molecular weight polymer component (thermoplastic organic binder composition) imparting gelling properties to the binder may be essentially any wax-soluble or wax-miscible polymer which will form a gel upon cooling, in the selected low-melting wax. Examples of useful polymers include crystalline polymers such as ultrahigh molecular weight polyethylene (UHMWPE), polyethylene/acrylic acid copolymers, butyl methacrylate/acrylic acid copolymers, and thermoplastic block copolymer elastomers such as styrene tri-block copolymers. For polymers which form gels through hydrogen bonding such as the acid functional copolymers, polymer types comprising four or more reactive (hydrogen bond forming) functional groups per molecule are preferred.

The selection of the high molecular weight polymer to be used in formulating the binder system is governed primarily by the solubility or miscibility of the selected polymer in the molten wax solution and the gelling characteristics thereof as the wax is cooled, as well as the extensional behavior of the polymer in the gel or working range of the binder, and the effect of the polymer on the green strength of the extruded part, all of which may be readily determined by experimentation.

A dispersion of the candidate polymer in a suitable low-melting wax such as a synthetic octadecanol wax is prepared and the solubility or miscibility of the polymer in the wax is determined. The wax solution or dispersion is then cooled and the presence or absence of gelling is noted.

The particularly preferred polymers for the formulation of thermoplastic binders are the tri-block styrene-ethylene/butylene-styrene copolymers. These elastomeric copolymers, commercially available under the trade-name Kraton® from the Shell Chemical Company of Houston, Tex., form exceptionally strong gels in wax solution of the aforementioned type. We have found Kraton® G1650 and G1651 (copolymers having ethylene-butylene midblock), to be particularly useful for the invention. Gelation of these polymers in wax solution is considered to be by association of the styrene endblocks, due to their thermodynamic incompatibility with the rubber midblock in the polymer. Tri-block copolymers have an effective functionality greater than 2, and thus readily form the strong three-dimensional gel structure desired for good reforming and dewaxing behavior.

The extruded batch must be slump resistant to maintain the shape of the extruded profile. Slump resistance is primarily a function of batch rheology. Ideally, the batch exhibits bingham or plastic flow such that the yield value of the batch prevents flow at low to zero shear rates. For thermoplastic or wax-based binders, cooling enhances shape retention. In the case of thermally gellable aqueous binders, heating enhances shape retention. Slumping can be prevented or substantially reduced by forming the cellular structure and the shell with batch materials having similar rheology. This is particularly true if the shell is extruded simultaneously with the core structure. In such cases, it is preferred that the core structure and the shell be formed from batch materials having similar binders. That is, if an aqueous binder is used for the core structure, the same is used for the shell. Similarly, if a thermoplastic polymer is used for the core material, the same is used for the shell. In one embodiment where the shell is not formed simultaneously with the core (FIGS. 5a–6b), different binder systems may be used for the core and shell. In this embodiment, the heat of the thermoplastic binder would gel the aqueous binder and aid the drying of the shell. Similarly, the evaporation of the water would facilitate cooling of the thermoplastic core extrudate.

The sinterable powders can be metal, metal oxides, and mixtures of these. For certain applications such as for automotive emissions control, the mixture may additionally contain a catalyst. To form an outside metal casing, a layer of sinterable particulate metal is formed around the monolith. The resulting structure comprising the encased monolith and outside metal layer is then fired to form a unitary structure. Upon firing, the metal or metal oxide (ceramic) powders sinter to form a metal or ceramic monolith respectively. While the outer layer of sinterable particulate metal fires to form a metal casing around the monolith.

A wide variety of sinterable particulate materials are known which may be used to prepare the objects which are encased in metal according to this invention and, specifically, to prepare a monolithic catalyst support. Examples of suitable particulate materials include metals, glasses, such as boro-silicates, soda-lime-silicates, lead-silicates, alumino-silicates, and alkaline earth silicates, and refractory compositions (ceramics), such as alumina, sillimanite, silicon nitrides, silicon carbides, mullite, fused silica, cordierite, magnesia, zircon, zirconia, petalite, spodumene, corundum, fosterite, barium titanate, porcelain, thoria, urania, steatite, samaria, gadolinia, various carbides including boron carbide, and spinels. Other suitable materials for forming the cellular monolith include glass-ceramics or sinterable ceramic and metal mixtures (cermets), e.g., chromium and alumina mixtures. Also suitable are objects formed from sinterable metal powders, e.g., powders of Fe, Al, Cu, Ti, Zr, Ni, Cr and various other alloys.

The method and apparatus of the invention are particularly useful for making aluminum-iron structures or catalytic substrates. Such catalytic substrates are porous metal bodies formed by sintering homogeneous mixtures of particulate Al, Fe and Mg and/or Ca with, optionally, Sn, Cu and/or Cr. The mixtures consist essentially, in weight percent, of 5–50% Al, 30–90% Fe, the sum of Al and Fe constituting at least 80% of the total composition, 0–10% Sn, 0–10% Cu, 0–10% Cr, the sum of Sn and Cu and Cr being less than 20%, and not more than 1% of an alkaline earth metal selected from the group consisting of Mg and Ca.

One particularly useful metal batch material for forming a metal cellular monolith consists essentially in percent by weight, of about 5 to 40 chromium, about 2 to about 30 aluminum, 0 to about 5 of special metal described below, 0 to about 4 of rare earth oxide additive, and the balance being iron group metal and unavoidable impurities, wherein the composition includes at least one component selected from (a) the special metal, and (b) an effective amount of the rare earth oxide additive, to enhance the life of the body. The special metal includes metals that impart or enhance desired properties in the structure such as, for example, oxidation resistance and/or metals that are used as densification aids in the sintering operation. The special metals are selected from Y, lanthanides, Zr, Hf, Ti, Si, B, alkaline earth metal, Cu, and Sn.

Another composition, particularly useful for catalytic converter applications but which is not limited to such applications, includes, in weight percent: (1) about 5 to about 40% chromium, (2) about 2 to about 30% aluminum, (3) about 0.01 to about 5% of at least one component selected from the following group A elements: Y, lanthanides, Zr, Hf, Ti, Si, and alkaline earth metal, and/or the following group B elements: B, Si, La, Ce, Cu, and Sn; (4) up to about 4% of rare earth oxide additive, and (5) the remainder being iron group metal and any unavoidable impurities.

For ease of extrusion the particulate powders are blended with an organic fluid medium or solvent which also contains an organic binder. Examples of suitable solvents include water, plasticizers, and certain waxes. The mixture of particulate powders, solvents and binders are blended until a rheology suitable for extrusion is obtained. As stated above, in general, either water-based systems extruded at slightly above room temperature, or wax-based systems extruded above the wax melt point may be employed.

As stated above, the batch material for forming the cellular structure is typically combined with a binder, preferably an organic binder. If a water-based system is used, the organic binder is preferably a cellulose ether such as methyl cellulose, either alone or in combination with a co-binder such as polyvinyl alcohol. In addition to the solvent and binder, other aids may be added such as aids to prevent oxidation of the metallic (e.g., oleic acid), or plasticizers to form a homogeneous wet mixture. Extrusion aids such as lubricants are also commonly employed.

When using aqueous binders, the mixture may contain up to 150% of water based on the amount of solids depending on the application. For metal catalysts such as electrically heated catalysts (EHCs), the mixtures may contain from 50 to 65% water based on the solids.

While both organic and inorganic binders may be used, organic binders are preferred. For water-based systems, certain cellulose ether type binders and/or their derivatives have been found to be particularly useful for forming the honeycomb structures of the invention. Examples of useful cellulose ether binders include methylcellulose and/or its derivatives such as hydroxypropyl cellulose, hydroxybutylmethylcellulose, ethyl hydroxy ethyl cellulose, dihydroxy ethyl cellulose, hydroxypropylmethylcellulose, hydroxyethylmethylcellulose, sodium carboxymethylcellulose, and mixtures thereof are preferred, particularly for forming thin-walled honeycomb structures. The cellulosic ether binders are utilized either alone or in combination with other water soluble binders such as polyvinyl alcohol. The preferred sources of the thermally gellable cellulose ether-type binders are the Methocel® A-type methyl cellulose binders available from Dow Chemical Company. The most preferred Methocel® A-type binder being Methocel® A4M, a methyl cellulose binder having a gel temperature of 50°–55° C., and a gel strength of 5000 g/cm$^2$ at 65° C. (based on a 2% solution). Methocel® A4M-containing article or preform is relatively stiff as it is extruded, however, at room temperature, cracks and fissures may form because the binder does not develop sufficient strength at room temperature to resist forces due to differential drying shrinkage. Therefore, it is desirable to quickly heat the extrudate sufficiently to gel the methyl cellulose in order to develop a large gel strength so as to resist subsequent cracking due to drying shrinkage. Methods for quickly developing the gel strength of such articles have been previously disclosed for example, in co-pending, co-assigned U.S. Pat. No. 5,205,991, which is herein incorporated by reference.

When using a non-aqueous thermoplastic binder, in addition, the binder formulation may also include optional organic additives, polymeric or otherwise, which are effective to reinforce or strengthen the high molecular weight polymer gel. Particularly desirable are additives which can increase the gel breakdown temperature of the binder. For example, certain high glass transition temperature ($T_g$) polystyrene resins can be added to gels incorporating tri-block polystyrene copolymer elastomers to increase the $T_g$ of the styrene domains, and hence the breakdown temperature of these gels. Hydrogen-bonded gels may also contain strengthening additives, strengthening in this case resulting from bridging between bonding sites on adjacent chains. Also in hydrogen bonded gels, ceramic fillers can play a significant role in gel formation; such gels are often much more pronounced and stable in the filled compounded batch than in the organic binder composition alone.

Other useful additives include modifying waxes such as Carnauba wax and oxidized polyethylene wax which may be added either to alter binder physical properties such as hardness, strength, or flexibility or to modify the flow characteristics of the binder system. Utilizing appropriate modifying waxes, binder formulations varying from extremely flexible at room temperature to hard and rigid at room temperature can be provided. In cases where particularly high flexibility is desired, a plasticizer such as butyl stearate may also be included in the binder formulation.

Added dispersants can have a substantial effect on the rheology of the binder and resulting batch. The use of appropriate dispersants allows for very high inorganic solids loadings, particularly in ceramic batches, which loadings would be difficult to achieve without such dispersants. Thus, in adequately dispersed systems, powder loadings as high as 60–70% by volume are readily achieved, even in batches incorporating ceramic powders with average particle sizes in the one micron range. An example of a useful dispersant for the batches of the invention is Hypermer KD-3, available from ICI Americas, Inc.

Particularly in the case of batches for ceramic part forming, any residual carbon, remaining after the removal of binders from the batch material may be detrimental to the development of desirable ceramic microstructure in the final product. It is therefore important that all of the organic constituents of the binder have excellent burn-out properties, such that there will be minimal or no potential for forming carbon during the binder removal process.

The batch materials are formed by combining the selected powder with a premixed binder in accordance with conventional procedures for using hot melt binders. Preferably, the powders are first pre-milled with a dispersant and a suitable solvent to thoroughly coat the powder with the dispersant. In a separate mixing step, the selected high molecular weight thermoplastic polymer or polymers are dissolved or dispersed in the wax components of the binder in a heated planetary mixer for example. The mixer is operated at a temperature above the melting temperature of the low melting waxes, and after the polymers have been dissolved or dispersed in these waxes other additives such as modifying waxes or the like are introduced and dissolved. The particulate material and dispersant are then added to the molten wax/polymer mixture in the planetary mixer, and hot mixing is continued until complete blending of the particulate and binder components, and subsequently complete volatilization of the solvent are achieved. If further mixing after solvent removal is desired, closed pressurized mixing equipment can be used to avoid the loss of the more volatile wax or other batch components.

Completion of the mixing process through solvent removal produces a thermoplastic paste exhibiting good fluidity or plasticity suitable for extrusion when heated and sufficient strength when cooled to allow for easy handling of the batch. Final mixing is typically carried out at temperatures in the range of about 120°–180° C.

To form the metal casing from sinterable particulate metal, the metal powders are added to a hot melt (thermoplastic) binders, or in an aqueous system, to a water soluble binder, then mixed with water to form a dough. The moisture content of the dough is adjusted to form a heavy paste which is desiredextrusion is accomplished at a moderate pressure through a peripheral or outer die portion having a variable width slot which is concentric to the core cellular die body. The thickness of the metal casing will depend on the slot width of the outer concentric die portion. The sinterable particulate or powdered metal used to form the metal shell or layer can be any metal available in powders or particles capable of being sintered to form a unitary metal structure. Examples of such metals include iron, aluminum, and copper as well as mixtures or alloys of any of such metals and all of the metals disclosed above in connection with the description of metal objects to be encased according to this invention. Stainless steel powders, especially the 300 and 400 series stainless steel powders, are particularly useful for forming the metal casing of the invention.

Without intending to be bound by theory, it is believed that in this embodiment, upon sintering, metal-metal bonds may be created between the underlying metal object and the metal casing. The porosity of the metal casing or shell may be the same or different from that of the encased object depending on the particular use. As with the cellular monolith, the metal casing may contain reinforcing materials such as whiskers or fibers of alumina, silicon nitride, silicon carbide, or carbon.

The size of the particles or powder is limited only by the width of the slot of the concentric outer portion of the die assembly. For reasons of safety and ease of processing, the particulate or powdered metal preferably has a particle size within the range of about 5 to 100 microns.

Since an organic binder is incorporated in the green metal casing, it is possible that the sintered metal casing will be porous. For automotive emissions control applications, it is preferred that the porosity of the metal casing be low (i.e., porosity less than about 10%). However, tests have shown that metal casings with porosities as high as 40% may be acceptable for such applications.

During the firing process, the particulate metal shell or encasement undergoes considerable shrinkage during the firing step. The underlying object (i.e., the cellular monolith) may not sinter as much and may therefore not shrink to the same degree as the metal casing. To avoid breakage due to differential shrinkage, it is desirable to carefully control the shrinkage differential between the metal casing and the underlying object. This can be achieved by selecting particulate materials for the cellular monolith, whose thermal expansion properties are similar to, or approach those of the sinterable particulate metal used for the casing.

Figure 7A:
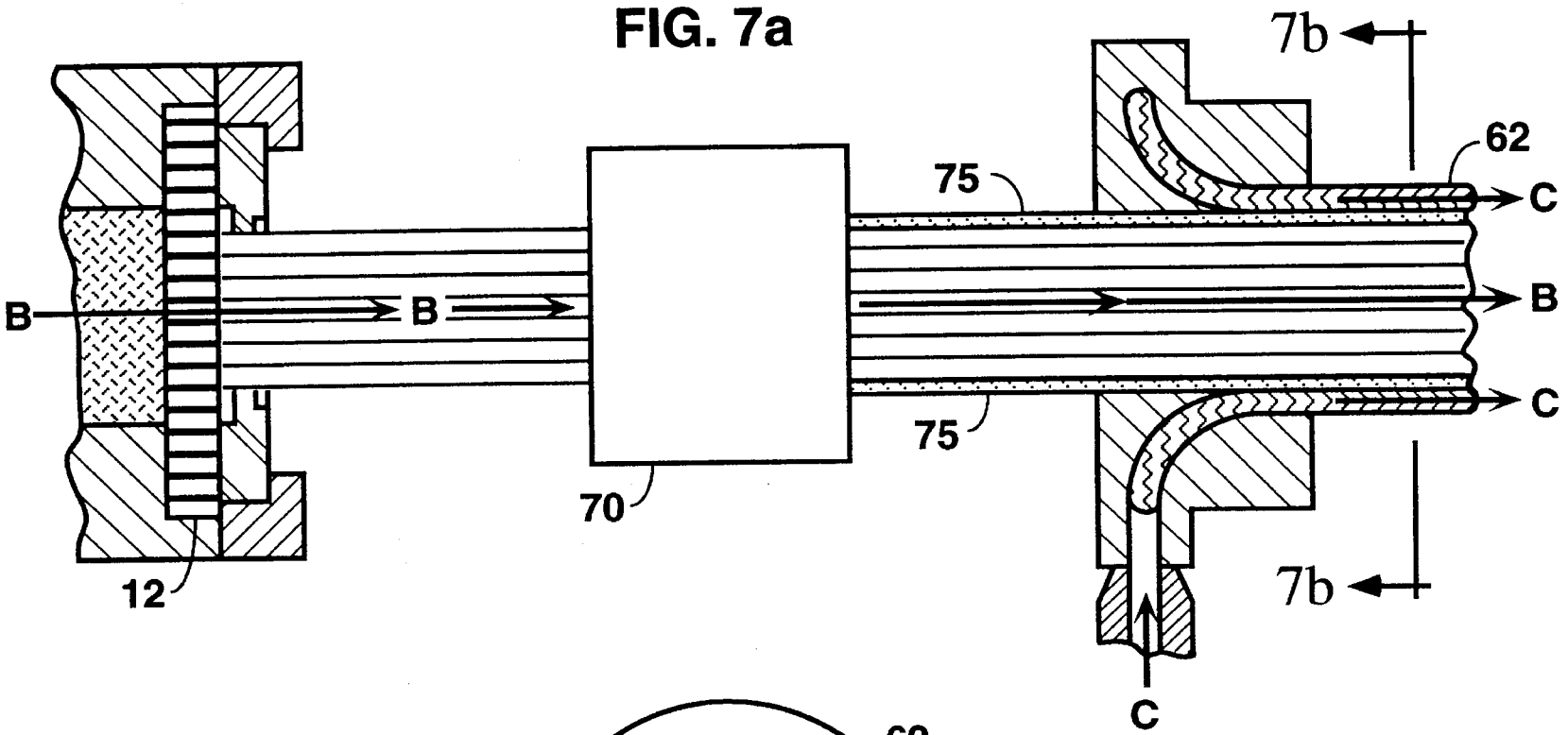
FIG. 7 is a schematic diagram of an alternative embodiment in which a resilient and compressible material is formed around the cellular central preform prior to the formation of the outside casing.
Figure 7B:
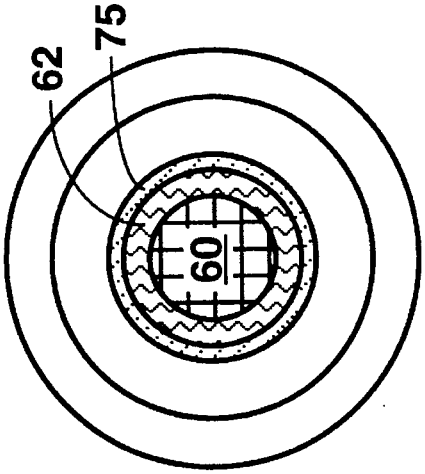

To further reduce the effects of differential shrinkage, a layer of resilient, compressible material can be interposed between the underlying cellular monolith and the metal casing. Any high temperature resistant material which is compressible, and capable of absorbing the stresses generated during the firing step, may be used for this purpose. Examples of useful materials for this material include compressible metal fibers, ceramic fiber meshes and/or mats such as steel wool, or a mat of zirconia or mullite. In this embodiment (FIG. 7), the resilient material 75 can be applied to the cellular material either simultaneously with the formation of the central cellular material and the outer casing, or preferably, subsequent to the formation of the cellular structure and before the outer shell is formed as shown in FIG. 7. To preserve the integrity of the cellular structure during formation of the resilient layer, and for ease of handling, the cellular structure may be sufficiently dried (in the case of an aqueous system), or cooled (in the case of a non-aqueous system), prior to application of the resilient material. The resilient material can be applied using any practical means 70 such as for example, by wrapping the cellular structure with a sheet of resilient, compressible material. Alternatively, if the resilient material can be provided in an extrudable form, it may be co-extruded with the central or core cellular material and the outer casing. Using this embodiment, a cellular structure having significantly different sintering properties can be formed. For example, a metal encased ceramic structure can be made by (1) extruding a cellular ceramic object, (2) drying the cellular object, (3) forming a resilient layer around the object, (4) forming a shell of sinterable metal around the resilient layer, and (5) firing the metal encased structure to sinter the object and the shell.

The metal-encased assembly is fired in a non-oxidizing environment under conditions suitable for sintering the metal particles into a unitary metal structure and to fire the underlying green structure. Suitable non-oxidizing gases include argon and forming gases such as mixtures of nitrogen and hydrogen. Generally, sintering temperatures are in the range of about 1000° C. to 1300° C. Excellent results can also be obtained by firing at 1300° C. in hydrogen gas.

The articles and methods of this invention are further illustrated in the following examples which are intended to be illustrative, but not limiting, of this invention. Formulations and methods of forming the cellular structure are well known in the art and are described in detail above. The following examples illustrate the formulation and method for forming the shell or metal casing around a cellular structure. Even though the cellular structure and the shell can be formed from the same batch material, in the following examples, the cellular monolith and the shell have been formed from different batch materials.

EXAMPLES

Cellular Monolith Composition

The methods of the invention were exemplified below using metal powders in the following composition. The fine particle component of these batches consisted of iron carbonyl powder (<6 microns) or titanium hydride powder, the fine particle components typically comprising about 28 volume percent of the metal powder component of the batches. Hot melt (thermoplastic) type binders were used in these examples.

TABLE I

| | 1 | 2 | 3 |
|---|---|---|---|
| Metal Powder (pbw) | | | |
| [a]Fe carbonyl powder | 738.21 | 655.2 | — |
| [b]Fe:Al powder (−325 mesh) | 628.84 | 558.14 | — |
| [c]Ti—Al powder (−100 mesh) | — | — | 284.8 |
| [d]Ti—$H_2$ powder | | | 362.4 |
| Binder Components (pbw) | | | |
| [e]styrene-ethylene/butylene-styrene triblock copolymer | — | 35 | 35 |
| [f]endblock modifier | — | 10 | 10 |
| [g]acid-functional ethylene/methacrylic acid copolymer | 50 | — | 20 |
| [h]acid-functional ethylene/methacrylic acid copolymer | — | 20 | — |
| [i]octadecanol wax | 15 | 25 | 25 |
| [j]hexadecanol wax | 35 | 10 | 10 |
| [k]particle dispersant | 4.37 | 2.59 | 5.12 |
| Batch Properties | | | |
| Volume % Solids | 67% | 65% | 59% |
| Theoretical batch density (g/cc) | 4.1 | 4.01 | 2.63 |
| Inorganic/organic weight ratio | 13.1 | 11.83 | 6.16 |

| Batch Component | Manufacturer |
|---|---|
| [a] = BASF OM Carbonyl Fe powder | BASF |
| [b] = Shield Alloy 50:50 Fe:Al powder, −325 mesh | Shield |
| [c] = Shield Alloy Ti—Al powder, −100 mesh | Shield |
| [d] = Powell Metal Ti—$H_2$ powder | Powell |
| [e] = $Kraton_R$ G1650 copolymer elastomer | Shell Chemical Company |
| [f] = Endex ™ 160 polymer | Hercules |
| [g] = Nucrel ™ 699 copolymer | Du Pont |
| [h] = Nucrel ™ 599 copolymer | Du Pont |
| [i] = octadecanol wax | Conoco Inc. |
| [j] = hexadecanol wax | Conoco Inc. |
| [k] = Hypermer ™ KD-3 dispersant | ICI Americas, Inc. |

The powder batches of Table I were formed into preforms by single-screw extrusion at temperatures above the gel breakdown temperatures of the batches. Extrusion was through a perforated mixing plate, 20 mesh screens, and the modified extrusion die of the invention to provide metal-encased extruded honeycombs.

The iron aluminide batches were extruded into 1.5-inch-diameter, square-channeled, monolithic honeycomb structures using a 1.5-inch single screw extruder. Using the co-extrusion method of the invention, an outer metal shell or encasement was formed around the honeycomb structure using a 0.75 inch diameter single screw extruder. Batch 1 required slightly lower extrusion pressure and showed slightly better extrusion quality than batch 2. However, Batch 2 exhibited faster gel formation on cooling and a higher green/melt strength, and was more slump resistant than Batch 1. As a result, the structure of Batch 2 set more rapidly after extrusion and was easier to handle than the structure of Batch 1. Both batches demonstrated good inter-particle packing and had good sintering characteristics, with low shrinkage and a very narrow pore size distribution after debindering and firing.

The titanium aluminide batch (Batch 3) was easily extruded into a 1-inch diameter, square-channeled, monolithic honeycomb structure, encased in metal and having acceptable properties. The structure substantially retained its extruded shape, exhibited good green strength, acceptable porosity, pore size distribution, and oxidation resistance.

Shell Composition

In the following examples, batch materials for the outer shell or encasement were prepared using stainless steel particulates and/or flakes having compositions A–F as shown in Table II. The resulting batch material was extruded around a Fe/Al honeycomb structure using the co-extrusion method of the invention.

TABLE II

| | Composition | | | | | |
|---|---|---|---|---|---|---|
| Component | A | B | C | D | E | F |
| [1]Neocryl B-723 | 50 | 50 | 50 | 50 | — | — |
| Kranton G-1650 | — | — | — | — | 30 | 30 |
| H. Octadecanol | 17 | 17 | 17 | 17 | 29.5 | 29.5 |
| H. Hexadecanol | 17 | 17 | 17 | 17 | 12 | 12 |
| Butyl Stearate | 16 | 16 | 16 | 16 | — | — |
| Nucrel 599 | — | — | — | — | 20 | 20 |
| Hypermer KD-3 | 1.88 | 1.88 | 1.88 | 1.88 | 2.5 | 2.88 |
| 316 Spherical Stainless Steel | 831.4 | 1016 | 1247 | 1544 | 1125 | 1385.9 |
| Vol. % Solids | 50 | 55 | 60 | 65 | 55 | 60 |
| Fired Porosity (%) | 27.5 | 30.9 | 28.4 | — | 29.9 | 35.0 |

[1]an acrylic binder available from Polyvinyl Chemicals.

Using a 0.020" ribbon die, compositions A through D, containing Neocryl B-723 formed acceptable shells around the honeycomb structures. However, during the sintering step they exhibited excessive slumping. The slumping observed in these compositions can be reduced by extruding the shell using the variable width slot and/or by increasing the thickness of the shell. Compositions E and F containing Kraton® (a copolymer elastomer) and Nucrel® (acid-functional copolymer), were tougher to extrude but more resistant to slumping than the earlier compositions.

Although the now preferred embodiments of the invention have been disclosed, it will be apparent to those skilled in the art that various changes and modifications may be made thereto without departing from the spirit and scope of the invention as set forth in the appended claims.

We claim:

1. A method of forming an integrally encased cellular structure by a) providing an apparatus comprising a die body and a shell or encasement forming means;

b) extruding a first batch material longitudinally through the die body to form a cellular structure c) passing a second batch material longitudinally through the shell forming means concurrently with the first batch material and controlling the flow of the second batch material whereby the second batch material is engaged to and is knitted with the first batch material to form a shell or encasement of the second batch material around the cellular structure, wherein the second batch material is compositionally different from the first batch material and is comprised of sinterable particulates or powders comprised of metal.

2. The method of claim 1, wherein the die body is characterized by an inlet face, an outlet face and a matrix of interconnected pins, a peripheral cylindrical surface communicating with the shell or encasement forming means, the cylindrical surface being concentric with the longitudinal axis of the die body, and an annular planar surface communicating with the cylindrical surface and extending transversely of the longitudinal axis.

3. The method of claim 2, wherein the shell or encasement forming means comprises an inner peripheral surface concentric with the peripheral cylindrical surface of the die body and spaced a given distance therefrom to provide an adjustable shell forming slot or gap therebetween for adjustably positioning the shell forming means from the peripheral cylindrical surface of the die body to provide a desired shell or encasement thickness.

4. The method of claim 1, wherein the first batch materials are comprised of sinterable particulates or powders, binder and a volatile component.

5. The method of claim 4, wherein the sinterable powders comprise glasses, ceramics, metals and mixtures of these.

6. The method of claim 4, wherein the volatile component is present in an amount in the range of 50 to 65% based on the solids.

7. The method of claim 6, wherein the volatile component comprises water, organic solvent and wax.

8. The method of claim 7, wherein the volatile component comprises a wax of fatty alcohols, fatty acids, fatty glycols, fatty glycerides and their derivatives.

9. The method of claim 8, wherein the waxes are crystalline solids at room temperatures having melting temperature no greater than 80° C.

10. The method of claim 4, wherein the first and second batch material further comprise dispersants, wetting agents and plasticizers.

11. The method of claim 4, wherein the binder is selected from the group consisting of cellulosic ether, polyvinyl butyryl, polyvinyl alcohol, acrylic polymers, styrene block co-polymers and derivatives of these.

12. The method of claim 11, wherein the binder is a water soluble cellulosic ether selected from methylcellulose, ethyl hydroxy ethyl cellulose, hydroxy propyl cellulose, hydroxybutylmethylcellulose, polyvinyl alcohol, hydroxypropylmethylcellulose, hydroxyethylmethylcellulose, sodium carboxymethylcellulose, and mixtures thereof.

13. The method of claim 4, wherein the second batch material consists of about 60–85% by weight of solids.

14. The method of claim 4, wherein the binder is a thermoplastic polymer dissolved in a wax which forms a gel structure upon cooling.

15. A method of forming an integrally encased cellular structure by a) providing an apparatus comprising a die body, the die body comprising a central portion and a peripheral portion;

b) extruding a first batch material longitudinally through the central portion of the die body; and c) concurrently passing a second batch material longitudinally through the peripheral portion of the die body and thereafter collecting the second batch material within a reservoir, wherein the second batch material is compositionally different from the first batch material;

e) causing the second batch material to flow through an adjustable control gap for adjusting the volume of the flow;

f) causing the second batch to flow through a variable width slot which for varying the thickness of the shell; and, g) causing the flow of the first batch to engage with and knit with the second batch material to provide a honeycomb structure with an integral outer casement thereon.

16. The method of claim 15, further comprising the step of firing the resulting structure to form a sintered unitary structure characterized by a central cellular portion, circumferentially encased by an outer layer.

17. The method of claim 16, wherein the encased cellular structure is fired at a temperature of about 1000° to 1300° C.

18. The method of claim 17, wherein the structure is fired in a non-oxidizing atmosphere.

19. The method of claim 15, wherein the cellular structure is dried or cooled prior to forming the shell or encasement.

20. The method of claim 15, wherein the sinterable powders comprise Fe, Al, Cu, Ti, Zr, Ni, Cr, Sn, and mixtures of these.

21. The method of claim 20, wherein the sinterable powders comprise stainless steel having particle size in the range of 5 to 100 microns.

22. The method of claim 20, wherein the first batch material consists essentially, in weight percent based on the amount of solids, of 5–50% Al, 30–90% Fe, 0–10% Sn, 0–10% Cu, 0–10% Cr, wherein the sum of Al and Fe is at least 80% of the total composition, and the sum of Sn and Cu and Cr is no greater than 20% of the total batch composition.

23. The method of claim 22, wherein the particulate powders further comprise alkaline earth metals and rare earth oxides.

24. The method of claim 23, wherein the particulate powders consist essentially in percent by weight of:

(a) about 5 to 40% chromium;

(b) about 2 to about 30% aluminum;

(c) 0.01 to about 5% of special metal selected from Y, lanthanides, Zr, Hf, Ti, Si, B, alkaline earth metal, Cu, and Sn;

(d) 0.01 to about 4% of rare earth oxide additive; and (e) the balance consisting essentially of iron group metal.

25. The method of claim 24, wherein the amount of alkaline earth metal is at most 1% based on the amount of solids.

26. The method of claim 22, wherein the alkaline earth metal is selected from the group consisting of Mg and Ca.

27. The method of claim 15, wherein the first batch material further comprises a catalyst.

28. The method of claim 15, wherein the cellular structure is a honeycomb.

29. The method of claim 15, further comprising the step of forming a layer of resilient compressible material on the cellular structure prior to forming the shell or encasement to form an encased cellular structure wherein the resilient material is interposed between the cellular structure and the shell or encasement.

30. The method of claim 29, wherein the layer of resilient compressible material is selected from metal fiber, ceramic fiber, metal mesh, and ceramic mesh.

31. The method of claim 15, wherein the first and second batch materials comprise sinterable particulates or powders, binder and a volatile component.

32. The method of claim 31, wherein sinterable powders comprise glasses, ceramics, metals and mixtures of these.

33. The method of claim 31, wherein the sinterable particulates or powders of the first batch material are selected from the group consisting of glasses, ceramics, cermets, and mixtures of these.

34. The method of claim 31, wherein the sinterable particulates or powders of the second batch material comprise metal.

35. The method as of claim 3 wherein the shell or encasement forming further comprises an adjustable flow control means positioned upstream from the adjustable shell forming slot for controlling of flow of the batch forming material.

* * * * *